United States Patent [19]

Sakamoto

[11] 4,223,543

[45] Sep. 23, 1980

[54] SMALL SIZE, PORTABLE BENDER

[75] Inventor: Kaneaki Sakamoto, Chigasaki, Japan

[73] Assignee: Kabushiki Kaisha Chuck Seisakusho, Kanagawa, Japan

[21] Appl. No.: 16,879

[22] Filed: Mar. 2, 1979

[30] Foreign Application Priority Data

Apr. 14, 1978 [JP] Japan ..... 53/48216
Sep. 4, 1978 [JP] Japan ..... 53/123852

[51] Int. Cl.[2] ..... B21D 7/024
[52] U.S. Cl. ..... 72/30; 72/217
[58] Field of Search ..... 72/30, 217–219, 72/149

[56] References Cited

U.S. PATENT DOCUMENTS 3,895,509 7/1975 Paddinghaus ..... 72/217
4,052,875 10/1977 Sakamoto ..... 72/217

*Primary Examiner*—Milton S. Mehr
*Attorney, Agent, or Firm*—Carroll F. Palmer

[57] ABSTRACT

A small size, portable bender operable from a domestically available A.C. source of the order of 100 V having the drive shaft turned through the intermediary of a clutch from a motor to perform a bending operation. Bending angle control means are provided to regulate the clutch to discontinue the bending operation at a desired angle. The bending angle is preset by angle preset means which may be locked in the preset position.

5 Claims, 11 Drawing Figures

SMALL SIZE, PORTABLE BENDER

BACKGROUND OF THE INVENTION

This invention relates to a small size, portable bender for bending a steel rod or tube, and particularly to a bending machine capable of being transported and easily placed on the spot by the hands of a user himself without involving any other expedients, and operated by an AC electric source of the domestic order of 100 volts.

Such a small size, portable bending machine is disclosed in my U.S. Pat. application No. 712,144, now U.S. Pat. No. 4,052,875. The disclosed bending machine includes a drive shaft adapted to be turned by a drive force against action of return spring means for actuation of a bending member, a clutch interposed to transmit the drive force to the drive shaft, and bending angle control means responsive to an adjusted angular position of the drive shaft for disconnecting the clutch when the drive shaft and being member have turned to the adjusted angular position. A steel rod or tube can be thus bent to an intended angle. After the bending operation, the return spring means act to urge the drive shaft and the related bending means toward the home position, building up kinetic moment to a fairly great degree until the drive shaft and its related components including the bending member, reach the home position where the accumulated moment is then annihilated to cause a substantial impact. This obviously generates somewhat offensive noises and causes wear and tear in the moving machine components.

When the machine operates to bend a certain number of steel rods or tubes one after another to a predetermined angle, as ordinarily is the case, such impact generated after each cycle of the bending operation will place the machine in vibratory conditions that a mechanical arrangement incorporated for a user to manually preset an intended bending angle is likely to be shifted from a position which has been preset for the intended bending angle. If the angle preset arrangement is so shifted to a different position, steel rods or tubes can no more be bent to the initially preset bending angle so that the cyclic bending operation has to be interrupted for corrective resetting of the intended bending angle.

The bending machine under discussion, moreover, often proves unsatisfactory in preciseness of selected degrees of angle to which materials are desired to be bent because the angle preset arrangement cannot provide a substantially continuous selection but only a stepwise selection of bending angles, because of its structural limitations.

SUMMARY OF THE INVENTION

One of the objects of the invention is to provide a small size, portable bender including operatively movable components which can be returned to the home position after the bending cycle without involving generation of great impact.

Another object of the invention is to provide a small size, portable bender where a bending angle can be preset selectively in a non-stepwise, continuous manner so that steel rods or tubes can be bent to a precisely determined degree of angle.

Still another object of the invention is to provide a small size, portable bender where a bending angle can be preset in a manner free from possible adverse shift from an initially set bending angle.

DESCRIPTION OF THE PREFERRED EMBODIMENTS

Figure 1:
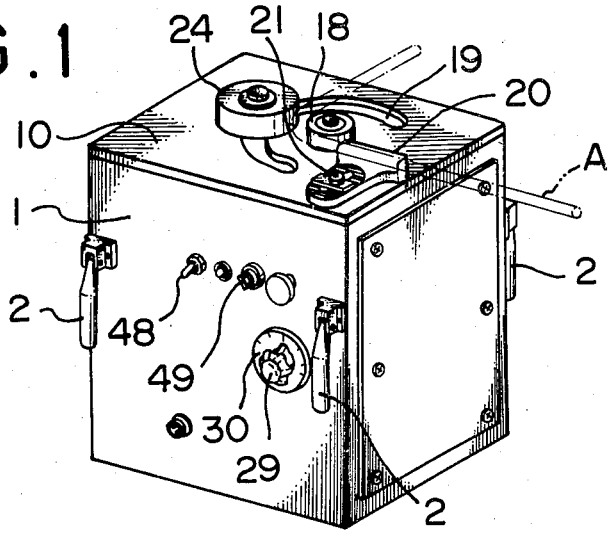
FIG. 1 shows a perspective view of a bending machine of one embodiment of the invention.
Figure 2:
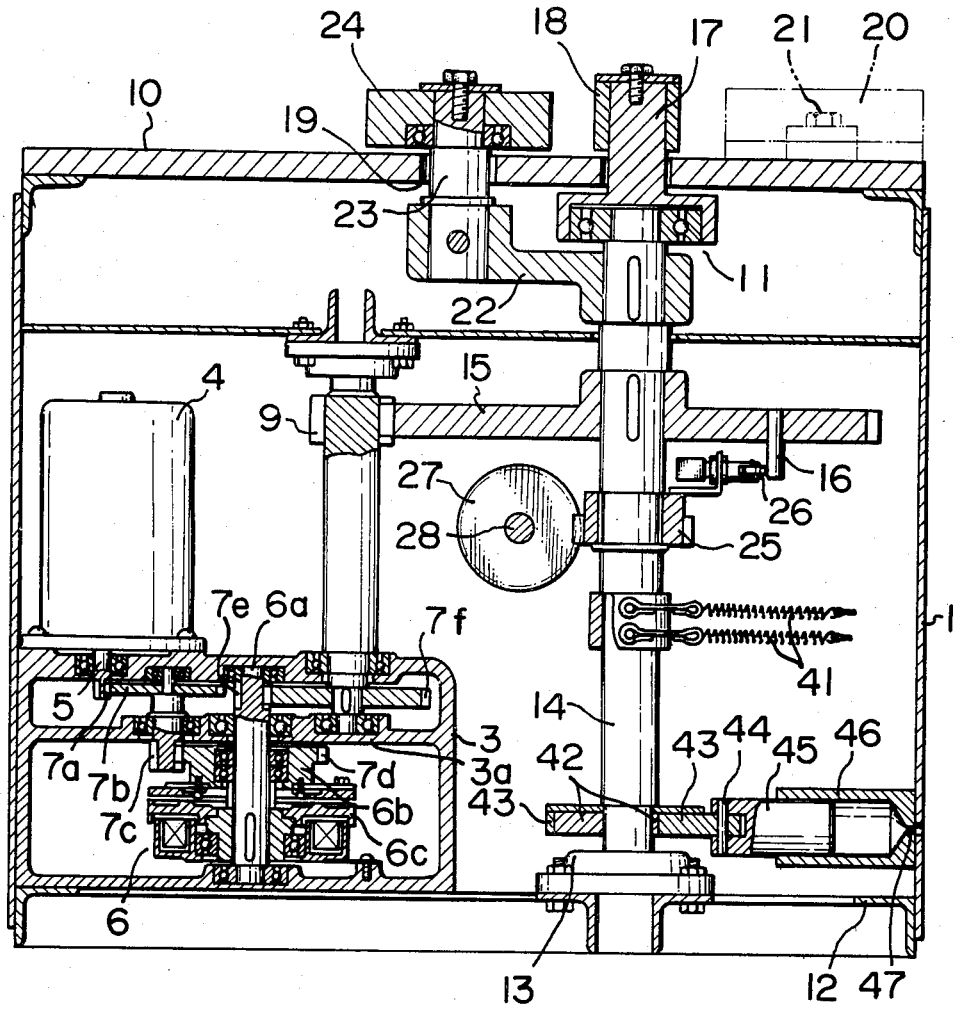
FIG. 2 is a cross-sectional view of the bending machine of FIG. 1.
Figure 4:
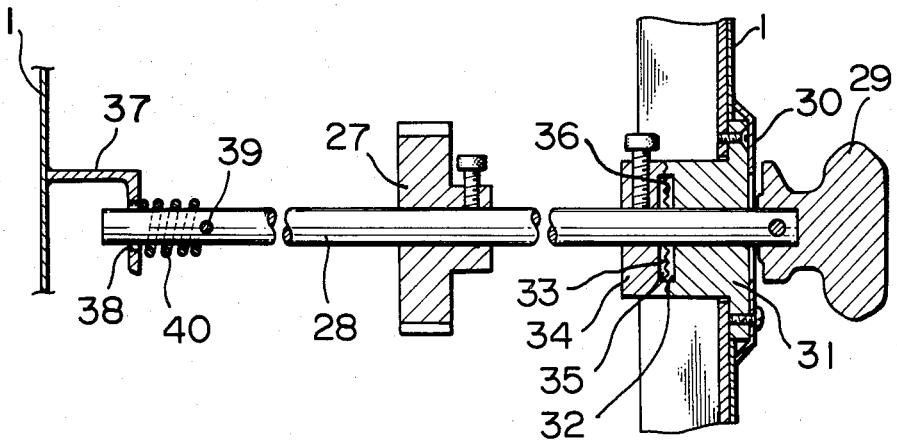
FIG. 4 cross-sectionally shows the bending angle preset arrangement incorporated in the bending machine of FIG. 1.

Reference is first made to FIGS. 1 and 2 in which a bender embodied by the invention is illustrated to include a generally cubiform case body 1 made of a suited light metal and in a small size enough to permit transportation by one's hands and provided on the lateral walls with suitable handles 2,2 to facilitate handling in transportation. Case body 1 has a top wall 10 and a bottom wall 12, top wall 10 having a thickness enough for its outer surface to serve as a table on which steel rods or tubes are to be bent in a manner hereinafter described.

Within case body 1 is disposed a hermetically sealed, compact casing 3 which is located on the bottom wall adjacent one corner thereof, and has a partition wall **3*a* horizontally extending in the interior to partition the latter into an upper and a lower compartments. The compact casing has a series of reduction gears 7*a*–7*f* and an electromagnetic clutch 6 accommodated in the hermetically sealed interior. The hermetical sealing of compact casing prevents the electromagnetic elements of clutch 6 from electrostatically collecting dust particles and other alien objects onto clutch 6. The electromagnetic clutch in compact casing 3 comprises a clutch shaft 6*a* upstandingly extending through the partition wall 3*a* to be received rotatably between the top and bottom walls of compact casing 3, and a pair of clutch wheels 6*b* and 6*c* disposed coaxially around shaft 6*a* and located in the lower compartment of compact casing 3, one and the other wheels 6*b* and 6*c* being freely and rigidly rotatable relative to shaft 6*a*, respectively, with the latter wheel shiftable longitudinally into and out of engagement with the former. Solenoid actuator means are disposed around clutch shaft 6*a* to actuate shiftable wheel 6*c* relative to wheel 6*b***.

An electric motor 4 is mounted exteriorly on the top of compact casing. The motor is of a miniature single-phase commutator type operable from a domestically available AC source of the order of 100 V to produce a relatively great starting moment and has a relatively small weight to facilitate transportation of the bender machine. The motor shaft 5 extends into the upper compartment of compact casing 3 and has the first reduction gear **7*a* integrally formed at the end to be meshingly engaged with the second gear wheel 7*b* located in the upper compartment. The second gear wheel 7*b*** is carried on an upstanding shaft journaled between the top and the partition walls of compact casing and having projecting in the lower compartment an end portion which has the third reduction gear *7c* formed to engage with the fourth gear *7d* in the periphery of clutch wheel *6b*. As clutch wheel *6b* is engaged by shiftable clutch wheel *6c*, the latter may transmit the rotational force from clutch wheel *6b* to clutch shaft *6a*. Clutch shaft *6a* has the fifth reduction gear *7e* integrally formed in the upper end portion.

An output shaft 8 is provided to extend upstandingly from compact casing 3 to have an upper end seated in suitable pillow means in case body. The lower end portion of output shaft 8 extends in the upper compartment of compact casing 3 wherein the final reduction gear wheel *7f* is secured to engage with the fifth reduction gear *7e* on the upper end portion of clutch shaft *6a*. A pinion 9 is rigidly secured on the upper end portion of output shaft 8 and meshingly engaged with a great-diameter toothed wheel 15 rigidly secured on a drive shaft 14. Drive shaft 14 extends vertically in body case and is turnably supported at the upper end by means of a spherical bearing device 11 disposed on the underside of the top wall 10 and at the lower end by means of a pillow block 13 on the bottom wall 12 of body case.

Spherical bearing device 11 has a housing which extends rigidly through the top wall of case body to form a stationary shaft 17 protruding coaxially with drive shaft 14 on the outer surface of the case body top wall or the working table. The stationary shaft 17 having a sleeve 18 fitted thereon serves to position a material A to be bent, as shown in FIG. 1, in cooperation with a stopper block 20 which is secured by means of a setscrew 21 in a position spaced from the stationary shaft 17. The stopper block may be adjustably moved by releasing the setscrew to receive in place materials of various diameters. Drive shaft 14 has an arm 22 radially secured to the upper end thereof, and the arm 22 rigidly receives an upstanding bending shaft 23 at the radially outer end. Bending shaft 23 protrudes through a slot 19 formed in the top wall of body case along an arcuate locus spaced from stationary shaft 17 at an equal distance to the length of radial arm 22. A bending roller 24 is turnably secured on the protruding end of bending shaft 23. When drive shaft 14 is turned, bending roller 23 is moved along the arcuate slot, i.e. in an eccentrically spaced path from the stationary shaft 17, as shown in FIG. 1, to bend material positioned in the above stated manner. Bending roller 24 can be replaced with rollers of varied diameters when materials to be bent have different diameters.

Figure 3:
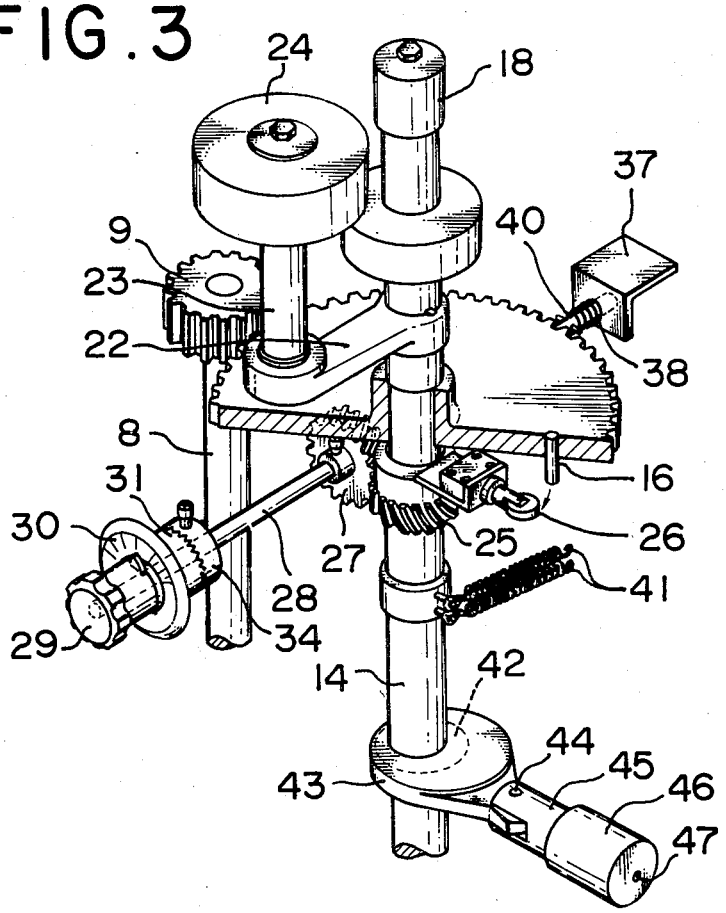
FIG. 3 is a perspective, partially broken view of the operative components incorporated in the bending machine of FIG. 1.

A bending angle control mechanism shown in FIG. 3 is incorporated in the bender, which functions to disconnect electromagnetic clutch 6 during turning of drive shaft 14. A helically toothed annulus 25 is disposed for free turning on drive shaft 14 and is spaced at a suitable distance from the underside of great-diameter toothed wheel 15. A pin 16 is planted in toothed wheel 15 to project from the underside thereof. A miniature switch 26 is carried on the annulus 25 and placed to lie in a locus of the free end of the pin 16 upon turning of toothed wheel 15. Miniature switch 26 is thus adapted to be actuated by abutting pin 16 in toothed wheel 15 and generate an electrical signal in suitable circuit means to actuate the solenoid actuator means in clutch 6 for disengaging the latter. The annulus 25 carrying miniature switch 26 is meshingly engaged with a helical gear wheel 27 rigidly secured on a rod 28. Rod 28 has an inner end supported loosely in an opening 38 of a bracket 37 on the body case wall and an outer end portion also loosely extending through a retainer member 31 in the opposed wall portion of body case so that rod 28 is not only turnable, but movable in the longitudinal direction. Rod 28 has a counterpart retainer member 34 rigidly secured on the periphery adjacent the outer end portion and a coil spring 40 disposed around the inner end portion to be interposed between the bracket 37 and a pin 39 which is planted in the rod. The spring 40 acts to longitudinally urge rod 28 in a direction so that counterpart retainer member 34 on rod 28 is abuttingly engaged with retainer member 31 in the respective opposed end surfaces thereof for locking rod 28 against its tendency of turning about its axis. The opposed end surfaces of retainer members 31 and 34 are recessed at 32 and 35 to leave annular edge projections in which a plurality of teeth 33 and 36 are formed. The meshing engagement between the teeth 33 and 36 on the opposed end surfaces of the two retainer members ensures the locking action against tendency of rod 28 for axial turning. To unlock and turn rod 28 about its axis, a thumb knob 29 is secured to the extremity of rod 28 projecting from the outer body case wall surface. Thumb knob 29 is spaced from the outer body case wall surface at a distance which allows rod 28 to be longitudinally moved inwards to disengage counterpart retainer member 34 from the fixed retainer member 31 in body case wall when a depression force is manually exerted onto thumb knob 29. When the retainer members have thus been disengaged from each other, rod 28 and accordingly gear wheel 27 may be manually turned by means of thumb knob 29 to turn annulus 25 thereon carrying miniature switch 26 which is thereby brought to an adjusted angular position relative to pin 16 in toothed wheel 15 when drive shaft 14 and its related moving components are in the home position. Once miniature switch 26 is brought to an adjusted angular position, manual depression force is removed from thumb knob 29 for coil spring 40 to allow rod 28 to be outwards urged whereby counterpart retainer member 34 on the rod is engaged with retainer member 31 fixed in body case wall. Miniature switch 26 is held in that position set relative to the home position of pin 16, with rod 28 being blocked again against its further axial turning tendency. It should be noted that miniature switch 26 can be adjusted to a position relative to pin 16 in wheel 15 in a substantially non-stepwise manner when the engagement teeth 33 and 36 are minutely formed in the opposed end surfaces of retainer members 31 and 34.

When electromagnetic clutch 6 is then actuated to the engagement position through a switch 49 manually closed after a manual power switch 48 has been closed to energize electric motor 4. A rotational force derived from motor 4 is then transmitted via shiftable clutch wheel *6c*, clutch shaft *6a*, output shaft 8, pinion 9 and toothed wheel 15 to drive shaft 14, whereby radial arm 22 is swung to move bending shaft 23 along arcuate slot 19 for bending operation of material A positioned on table 10 by the aid of stopper block 20 and stationary shaft 18. Drive shaft 14 continues the operative turning until pin 16 in the toothed wheel 15 comes to abut against miniature switch 26 to actuate the latter for opening clutch 6 to disconnect transmission of drive force to drive shaft 14. At this time, bending shaft 23 has moved and bent material A in a corresponding angle, say 90°, to the preset angle had by minature switch 6 relative to pin 16. Drive shaft 14 is provided with return spring means 41 having one end secured to body case wall and the other to the periphery of drive shaft 14. Return spring means 41 which has been thus expanded during the operative turning of drive rod 14 acts to cause drive shaft 14 and its related components to return to the home position when clutch 6 is actuated in the above stated manner to disconnect transmission of drive force.

It will be appreciated that impact may be generated when drive shaft 14 and its related bending mechanism reach the home position. To lower an undesired degree of such impact, impact damping means are provided in the lower end portion of drive shaft 14. As most clearly shown in FIG. 5, a circular cam disc 42 is eccentrically secured to drive shaft 14 for integral rotation thereon. An annular member 43 is movably fitted around the whole periphery of cam disc 42, and has a rod 45 mounted at the peripheral end by means of a pivot pin 44. Rod 45 extends to be air-tightly received in a hollow cylindrical member 46 which is rigidly mounted on body case wall as in FIG. 2. In an end wall of the cylindrical member 46 remote from the open end through which rod 45 is fitted, formed is a constricted vent aperture 47 which is communicated with the ambient air through body case wall. As shown in FIGS. 1 and 2 where drive shaft 14 has been driven to bring bending shaft in a position about 90° away from its initial position, the most eccentric section of cam disc 42 is placed most apart from cylindrical member 46 so that the connected rod 45 is placed in the most outer position in cylindrical member 46, which position is depicted by solid lines in FIG. 5. As drive shaft 14 and its related components are thence returned to the initial position by action of return spring means 41, rod 45 is gradually plunged into cylindrical member 46 in which air thereby compressed acts as an air cushion while slowly released therefrom through constriction 47, whereby velocity of the returning movement of drive shaft 14 and its related bending members is reduced to diminish a degree of impact generated when the bending mechanism reaches the home position. In addition to the impact damping means, appreciable lowering of the impact is achieved by the fact that the machine has the arrangement in which clutch 6 disconnects transmission of drive force in the intermediary of the series of reduction gears so that return spring means 41 are to urge not only drive shaft 14 and its related bending members, but all the meshed components located at the output side of reduction gear series. It is thus understood that not only level of generated offensive noises is thereby diminished, wear being avoided particularly in bending shaft 23, but intensity of mechanical vibration which is particularly experienced in the continuous mode of bending operation of one predetermined bending angle. Such mechanical vibration can otherwisely cause shift of the bending angle control mechanism from a preset bending angle, when retainer member 34 disengages from the other member 31 against action of spring 40 to result in displacing rod 28 and accordingly miniature switch 26 to a shifted position from a preset angular position relative to the home position of pin 16 in wheel 15.

Figure 6:
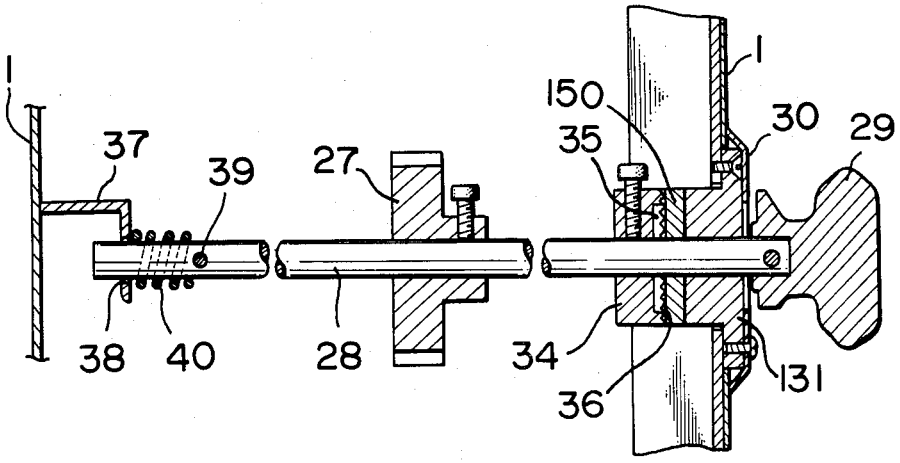
FIGS. 6–9 show various modifications of the bending angle preset arrangement.

The bending angle preset arrangement included in the control mechanism may be an alternative one of modifications shown in FIGs. 6–9 where similar elements to those in the above stated embodiment are designated by corresponding reference numbers. A first modification shown in FIG. 6 is identical to the above stated embodiment except that fixed retainer member 131 in body case wall has a flat opposed end surface to the recessed, toothed one of retainer member 34 rigidly secured onto rod 28. An elastomeric disc 150 is secured on the end surface of retainer member 131 to therein hold teeth 36 of the other member 34 under urging influence of coil spring 40, whereby rod 28 is locked against its tendency of axial turning. Thus, without teeth-to-teeth engagement between retainer members 131 and 34 for locking rod 28 in a preset angular position, the continuous flat engagement surface of elastomeric disc 150 enables an angular position of miniature switch 26 to be set in a substantially non-stepwise, continuous graduation, which helps enhance preciseness of preset bending angles. Alternatively, the elastomeric disc may be secured to the end surface of retainer member 34 on rod 28 while fixed retainer member 131 has a toothed end surface.

Figure 7:
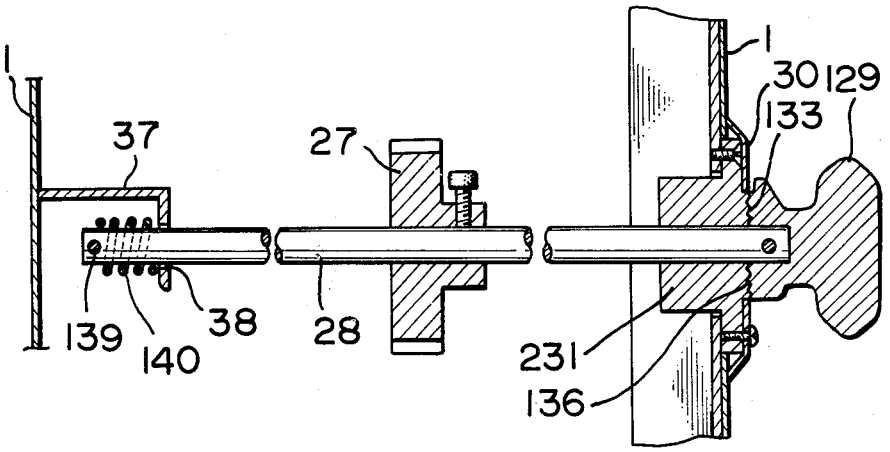
Figure 8:
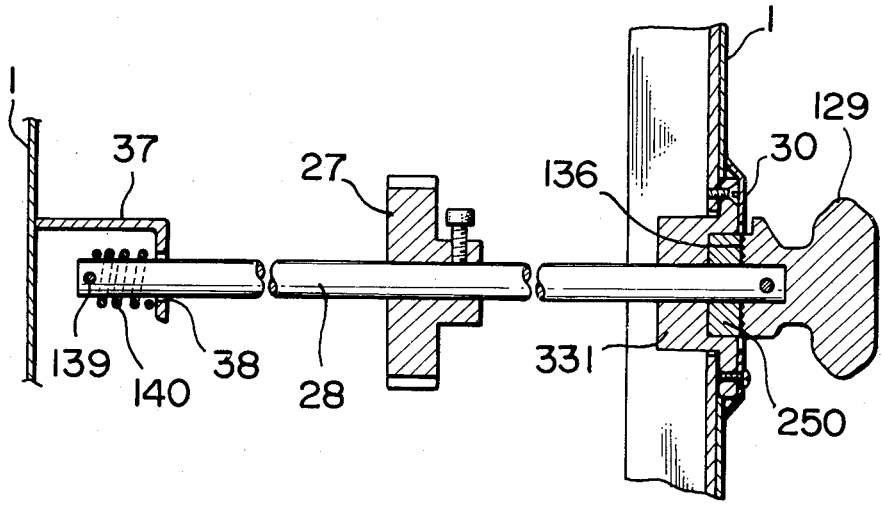
Figure 9:
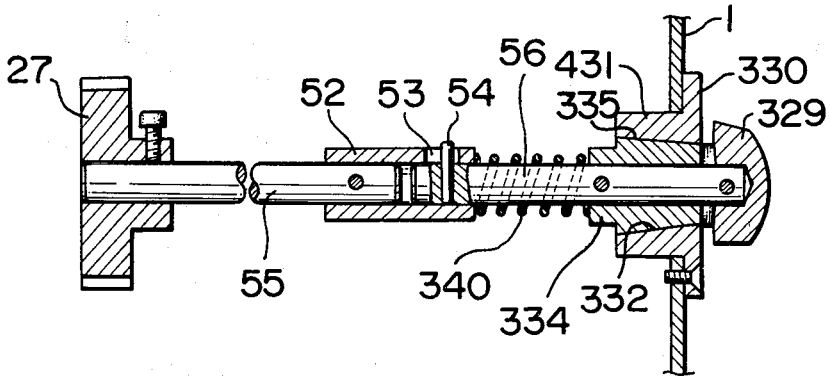

A second modification as shown in FIG. 7 is identical to the above stated embodiment except that one retainer member 231 is fixed in body case wall and has an end surface exposed exteriorly of the wall in which a plurality of teeth 133 are formed, and rod 28 has a thumb knob 129 secured to the outer projecting extremity and having a toothed surface 136 opposed to the toothed end surface of retainer member 231. Coil spring 140 is so interposed between bracket 37 and pin 139 on rod 28 as to urge rod 28 inwards, whereby the toothed surfaces 134 and 136 are engaged for locking rod 28 against its tendency of axial turning. The teeth on opposed surfaces 134 and 136 can be sufficiently minutely formed to enable substantially non-stepwise adjustment of an angular position of miniature switch 26. Pulling force is manually exerted to rod 28 to unlock and adjustably turn the latter. This particular arrangement dispenses with provision of the retainer member on rod 28. The second modification may be further modified to remove one of the teeth in opposed end surfaces of retainer means and to secure an elastomeric disc thereon. FIG. 8 shows such a modification where an elastomeric disc 250 is mounted on the end surface of retainer member 331 fixed in body case wall, and teeth 136 are formed on the opposed surface of thumb knob 129.

In a third modification, rod 28 is replaced by two rods 55 and 56 connected end-to-end through a coupling sleeve 52. The gear wheel 27 which meshes with miniature switch-carrying gear wheel 25 is secured to the inner end of rod 55. Coupling sleeve 52 which is rigidly secured to the outer end of rod 55 at one end opening loosely receives the inner end of other rod 56 in the other end opening and has a longitudinal slot-like opening 53 in the peripheral wall. Rod 56 has a pin 54 planted therein adjacent the inner end to peripherally project through longitudinal slot 53 in the sleeve 52. Rod 56 has a retainer member 334 and a thumb knob 329 rigidly secured adjacent and in the outer extremity, respectively. Retainer member 334 has a rounded peripheral surface 335 diametrically reduced gradually toward the outward direction and adapted to be fitted on the complementary shaped opening 332 of a retainer member 431 fixed in body case wall. Coil spring 340 is disposed about rod 56 having one end seated on the end face of coupling sleeve 52 and the other on the end face of retainer member 334 on rod 56, whereby rod 56 is urged outwardly to press tapered retainer member 334 into the tapered opening 332 of fixed retainer member 431 when pin 54 at the inner end of rod is located at the outer end of slot 53 in coupling sleeve 52. Fitting engagement of retainer member 334 in fixed retainer opening 332 will lock rod 56 and accordingly rod 55 against tendency of turning about the axes. When rod 56 is moved inwards by manual depression force to thumb knob 329 to disengage tapered retainer member 334 from fixed retainer member 431, with coil spring 340 compressed and pin 54 on rod 56 moved along slot 53, rod 56 may be manually turned, which turning is transmitted via pin 54 and coupling sleeve 52 to rod 55 which carries gear wheel 27 for adjustment of an angular position of miniature switch 26 relative to pin 16 in toothed wheel 15 disposed on drive shaft 14. Once an angular position of miniature switch 26 has been thus set, removal manual depressing force from thumb knob allows coil spring 340 to urgingly bring retainer member 334 into a fitting position in opening 332 of fixed retainer member 431 in body case wall. Thus, rods 56 and 55, and miniature switch 26 through gear wheels 27 and 25 are locked in a set position against tendency of turning. Retainer members 431 and 334 are fittingly engaged with each other on smooth round surfaces 332 and 335, to provide a non-stepwise, continuous graduation in which a desired bending angle may be precisely set.

It is to be understood that either of the above described modifications including the heretofore described embodiment permits miniature switch 26 once preset in an angular position relative to pin 16 to be held in that preset position against influence of impact and/or vibration ascribed to the bending member having returned to the home position. Such impact and/or vibration is diminished in the above mentioned manner, which obviously enables the bending machine to safely avoid any undesirable shift of a preset bending angle when a great number of materials are to be bent one by one in a repetative manner to a bending angle preset in a relatively great degree.

Figure 5:
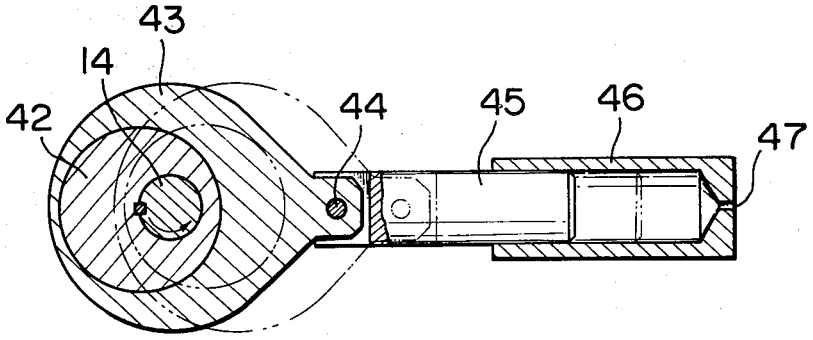
FIG. 5 cross-sectionally shows the impact damping means incorporated in the bending machine of FIG. 1.
Figure 10:
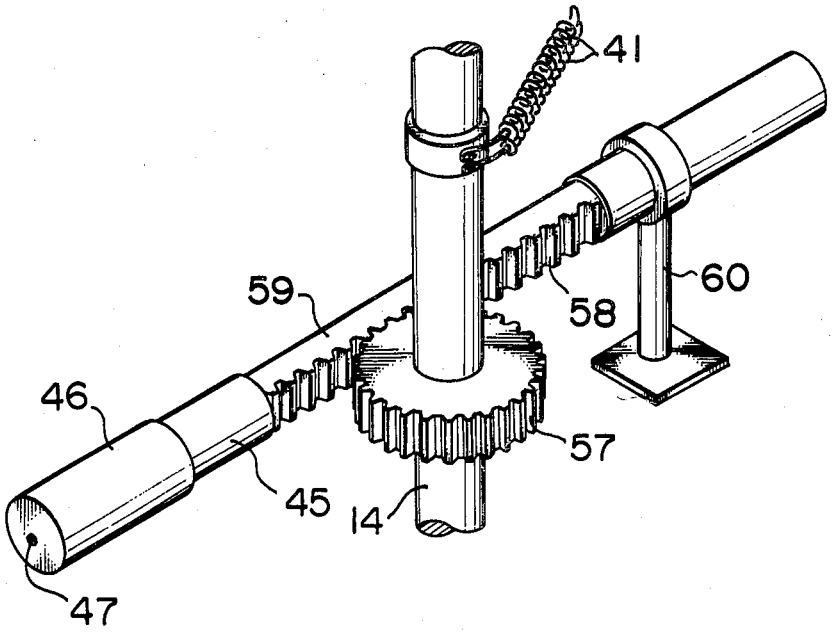
FIGS. 10 and 11 perspectively show modifications of the impact damping means.
Figure 11:
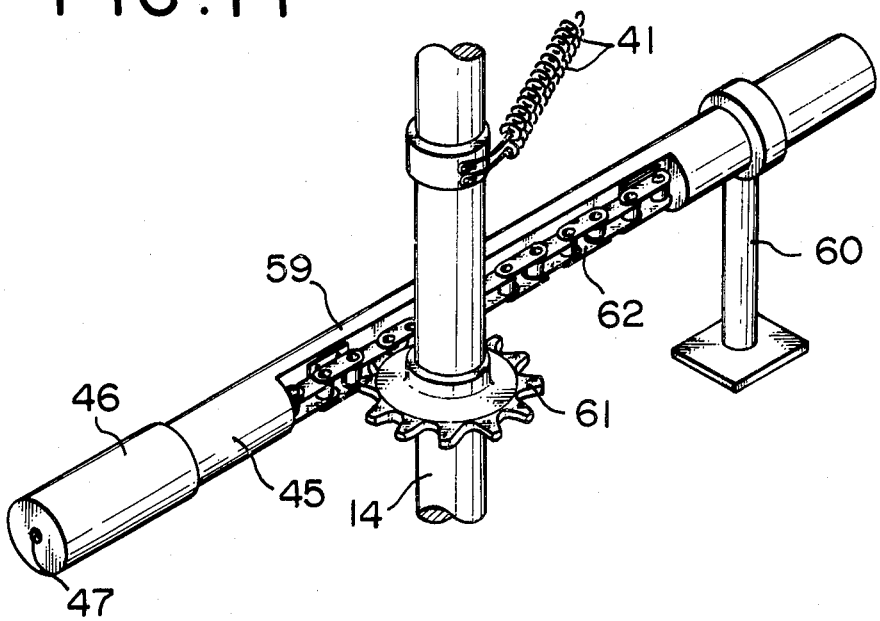

The impact damping means above described particularly with reference to FIG. 5 are particularly advantageous for saving space in that rod 45 has a short distance of stroke. If space allows, however, the impact damping means may be modified as shown in FIG. 10. A modification shown therein is similar to the above described damping means except that cam wheel 42 and its surrounding annular member 43 are replaced by a pinion wheel 57 rigidly mounted on drive shaft 14, and a stem 59 racked at 58 to meshingly engage with pinion wheel 57, respectively. Stem 59 is supported at one end by support post 60 and has rod 45 integrally formed at the other end, rod 45 being air-tightly slidably fitted in hollow cylindrical member 46 vented at 47. It is obvious that a similar damping action is achieved in the modification as in the heretofore described damping means, but the modification is more advantageous in strength and lifespan because rod 45 is stroked by a linear force exerted in an aligned direction with cylindrical hollow member 46. The modification may be further modified, as shown in FIG. 11, to secure a sprocket wheel 61, instead of pinion wheel 57, on drive shaft 14 where stem 59 is provided with a chain 62 to be engaged with sprocket wheel 61.

The invention should not be considered to be limited to the heretofore described embodiment and modifications. Indeed, pin 16 in the bending angle control mechanism may obviously be secured to drive shaft 14 or other member linked with turning of drive shaft than toothed wheel 15. Moreover, this pin may be any protrusion formed in toothed wheel 15 or any other surface means which turns together with drive shaft 14 to be adapted to actuate miniature switch 26. Such protrusion or surface means may, of course, be provided in annulus 25 turnably adjusted by the angle preset arrangement, instead of in toothed wheel 15 or other member turning together with drive shaft 14, wherein miniature switch 26 is disposed in this case. The means for returning drive shaft 14 upon disconnection of clutch 6 may be any other form than spring means as illustrated. It is obvious to one skilled in the art that modifications are feasible in other portions of the bending machine heretofore described only by way of example.

I claim:

1. A portable bender having a case body which is small in both size and weight enough to permit transportation of said bender by the hands of a user, and therein comprising a miniature, single-phase commutator motor, a drive shaft, a series of reduction gears for transmitting a rotational drive force from said motor to said drive shaft, electromagnetic clutch means for connecting and disconnecting the transmission of said rotational drive force to said drive shaft, a stationary shaft disposed coaxially of said drive shaft to protrude through said case body, stopper block means for a member to be bent disposed on the outer surface of said case body to be spaced at a determined distance from said stationary shaft, a slot formed in said outer surface to be arcuately elongated around the center of said stationary shaft, a bending roller provided on said outer surface and so linked to said drive shaft as to be turned along said arcuately elongated slot for applying a bending force to a member to be bent, bending angle control means including means for setting a determined degree of bending angle and means for locking said setting means and being operable to cause said clutch means to diconnect said rotational drive force from said drive shaft when said drive shaft has turned to said determined degree of bending angle, means for returning said drive shaft to the initial position when said clutch means disconnects said rotational drive force, and counteracting means against said returning means to lower velocity of the returning movement of said drive shaft and said bending roller.

2. The portable bender defined in claim 1 wherein said setting means include a miniature switch electrically connected to said clutch means, an actuator member for said miniature switch, either of said miniature switch and said actuator member being operatively coupled to said drive shaft, and means for manually displacing one of said miniature switch and said actuator switch for setting of said predetermined degree of bending angle.

3. The portable bender defined in claim 2 wherein said locking means is adapted to lock said displacing means.

4. A portable bender having a case body which is small in both size and weight enough to permit transportation of said bender by the hands of a user, and therein comprising a miniature, single-phase commutator motor, a drive shaft, a series of reduction gears including a first gear coupled to the shaft of said motor and a last gear couled to said drive shaft to transmit a rotational drive force from said motor to said drive shaft, electromagnetic clutch means located between said first and said last gears of said series of reduction gears for connecting and disconnecting the transmission of said rotational drive force to said drive shaft, a stationary shaft disposed coaxially of said drive shaft to protrude through said case body, stopper block means for a member to be bent disposed on the outer surface of said case body to be spaced at a determined distance from said stationary shaft, a slot formed in said outer surface to be arcuately elongated around the center of said stationary shaft, a bending roller provided on said outer surface and so linked to said drive shaft as to be turned along said arcuately elongated slot for applying a bending force to a member to be bent, bending angle control means including means for setting a degree of bending angle and means for locking said setting means and being operable to cause said clutch means to disconnect said rotational drive force from said drive shaft when said drive shaft has turned to said determined degree of bending angle, means for returning said drive shaft to the initial position when said clutch means disconnects said rotational drive force from said drive shaft, and means for pneumatically damping velocity of the returning movement of said drive shaft and said bending angle roller.

5. The portable bender defined in one of claims 1 or 4 and including a hermetically sealed casing in which at least said electromagnetic clutch means are housed.

* * * * *